US009046816B2

(12) United States Patent
Ajima

(10) Patent No.: US 9,046,816 B2
(45) Date of Patent: Jun. 2, 2015

(54) IMAGE FORMING APPARATUS AND TONER CARTRIDGE

(71) Applicants: Kabushiki Kaisha Toshiba, Minato-ku, Tokyo (JP); Toshiba TEC Kabushiki Kaisha, Shinagawa-ku, Tokyo (JP)

(72) Inventor: Hisanobu Ajima, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 77 days.

(21) Appl. No.: 13/756,736

(22) Filed: Feb. 1, 2013

(65) Prior Publication Data

US 2013/0223855 A1 Aug. 29, 2013

Related U.S. Application Data

(60) Provisional application No. 61/602,667, filed on Feb. 24, 2012.

(51) Int. Cl.
*G03G 15/08* (2006.01)
*G03G 15/00* (2006.01)

(52) U.S. Cl.
CPC ..... *G03G 15/0824* (2013.01); *G03G 15/556* (2013.01); *G03G 15/0849* (2013.01); *G03G 15/0853* (2013.01); *G03G 15/0863* (2013.01)

(58) Field of Classification Search
CPC ..... G03G 15/0824; G03G 15/0849; G03G 15/0853; G03G 15/0863; G03G 15/556
USPC ..... 399/27, 61, 62
See application file for complete search history.

(56) References Cited

U.S. PATENT DOCUMENTS

| | | | | |
|---|---|---|---|---|
| 5,778,279 | A * | 7/1998 | Kawai et al. | 399/42 |
| 7,218,871 | B2 * | 5/2007 | Ogata | 399/27 |
| 2005/0019047 | A1 * | 1/2005 | Katoh | 399/27 |
| 2010/0322644 | A1 | 12/2010 | Ajima | |

FOREIGN PATENT DOCUMENTS

| | | |
|---|---|---|
| JP | 2008-033197 | 2/2008 |

* cited by examiner

*Primary Examiner* — Ryan Walsh
(74) *Attorney, Agent, or Firm* — Amin, Turocy & Watson, LLP

(57) ABSTRACT

An image forming apparatus comprises: a storage medium 35 configured to arrange in a toner cartridge 30; a detection sensor 37 configured to detect the toner specific concentration of the developer in the developing apparatus 14; a control unit 100 configured to calculate a value corresponding to the drive time of the drive motor 31 to calculate an integrated count value for the toner cartridge, and output a message containing the cause of an abnormity corresponding to the count value when the toner specific concentration detected by the detection sensor shows a value indicative of the empty of the toner, wherein the count value and an empty information indicating whether or not the toner cartridge is empty are stored in the storage medium.

4 Claims, 7 Drawing Sheets

FIG.4

| TONER CARTRIDGE SIDE MEMORY (B) | |
|---|---|
| ADDRESS | INFORMATION CONTENT |
| B001 | IDENTIFICATION CODE |
| B002 | COUNT VALUE |
| B003 | EMPTY INFORMATION |

FIG.5

| MAIN BODY SIDE MEMORY (A) | |
|---|---|
| ADDRESS | INFORMATION CONTENT |
| A001 | IDENTIFICATION CODE |
| A002 | COUNT VALUE |
| A003 | EMPTY INFORMATION |

| LEVEL OF RESIDUAL TONER SENSOR | TIME OF TONER REPLENISHMENT ACTION |
|---|---|
| LEVEL1 | ON: 2sec, OFF: 5sec, n=1 |
| LEVEL2 | ON: 4sec, OFF: 5sec, n=2 |
| LEVEL3 | ON: 8sec, OFF: 5sec, n=2 |
| LEVEL4 | ON: 20sec, OFF: 5sec, n=3 |

IMAGE FORMING APPARATUS AND TONER CARTRIDGE

CROSS-REFERENCE TO RELATED APPLICATIONS

This application is based upon and claims the benefit of priority from U.S. Provisional Application No. 61/602,667 filed on Feb. 24, 2012; the entire contents of which are incorporated herein by reference

FIELD

Embodiments described herein relate to an image forming apparatus and a toner cartridge.

BACKGROUND

In an electrophotographic type image forming apparatus (Multi-Functional Peripheral), a visual image obtained by developing a latent image formed on a photoconductor serving as an image carrier using a toner is transferred to a medium (paper or resin sheet). The toner cartridge used in such an image forming apparatus is deemed as a consumable which needs to be replaced with a new one when the residual toner in the toner cartridge runs out.

However, in the case where no sensor is configured in the main body of a toner cartridge to detect the quantity of the residual toner in the toner cartridge, the quantity of the residual toner is estimated through calculation. For example, the quantity of the toner used and the quantity of the residual toner in the toner cartridge are indirectly estimated according to the replenishment time of the toner, the drive time of a processing unit and the count of the pixels printed, and then the residual toner is managed.

BRIEF DESCRIPTION OF THE DRAWINGS

FIG. 4 is a diagram illustrating the information stored in a storage medium arranged at the side of the toner cartridge in the image forming apparatus according to the embodiment.

FIG. 5 is a diagram illustrating the information stored in a file in a DRAM arranged at the main body side of the image forming apparatus according to the embodiment.

DETAILED DESCRIPTION

In accordance with an embodiment, an image forming apparatus comprises: a toner cartridge configured to store the toner for replenishing a developing apparatus; a storage medium configured to arrange in the toner cartridge; a detection sensor configured to be arranged in the developing apparatus and detect the toner specific concentration of the developer in the developing apparatus; a drive motor configured to replenish the developing apparatus with the toner from the toner cartridge; and a control unit configured to calculate a value corresponding to the drive time of the drive motor to calculate an integrated count value for the toner cartridge, and output a message containing the cause of an abnormity corresponding to the count value when the toner specific concentration detected by the detection sensor shows a value indicative of the empty of the toner, wherein the count value and an empty information indicating whether or not the toner cartridge is empty are stored in the storage medium.

Figure 1:
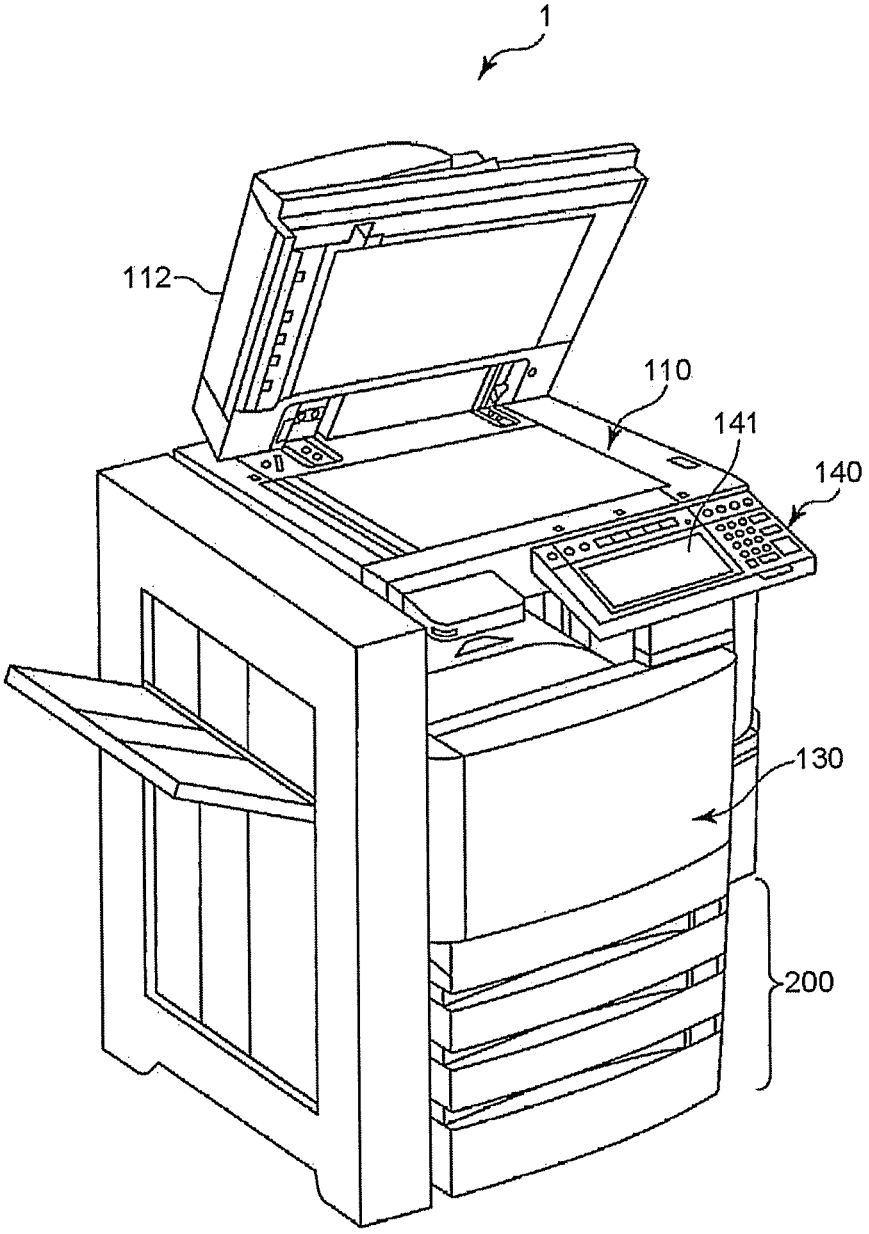
FIG. 1 is an oblique view showing the roughly shape of the image forming apparatus according to the embodiment.

FIG. 1 is an oblique view showing the roughly shape of the image forming apparatus 1 according to the embodiment.

A printing unit 130, a paper tray 200, a scanning unit 110, an automatic feed unit 112 and a control panel 140 are configured in the image forming apparatus 1.

The printing unit 130 outputs image information as the output image (called hard copy or print out) The paper tray 200 supplies an output medium of a paper in any size for an image output to the printing unit 130. The scanning unit 110 acquires, from an original, image information as image data. The automatic feed unit 112 guides the original to a reading position and discharges the read original from the reading position to a discharge position. The control panel 140 is an instruction input unit for instructing actions of the image forming apparatus 1, such as the start of an image forming action in the printing unit 130 or the start of the image information reading of the scanning unit 110 from the original. A display unit 141 for inputting an instruction and displaying information for an operator is configured on the control panel 140.

Figure 2:
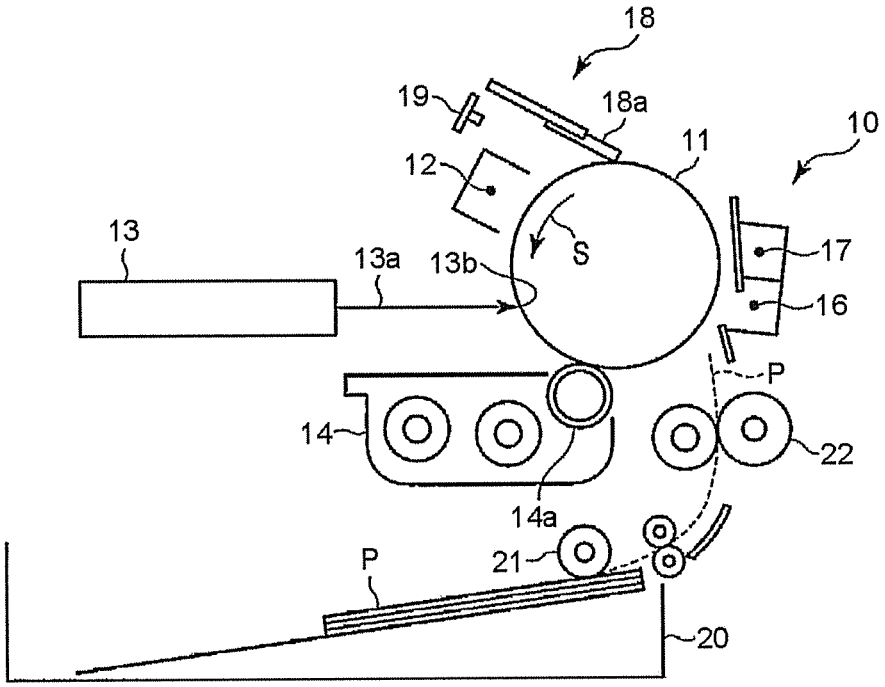
FIG. 2 is a diagram illustrating the configuration of the image forming unit of the image forming apparatus according to the embodiment.

FIG. 2 is a diagram illustrating the configuration of the image forming unit 10 of the image forming apparatus 1 according to the embodiment.

The photoconductive drum 11 of the image forming unit 10 has an organic photoconductor (OPC) on the surface of a supporting member which have diameter of 60 mm. The photoconductive drum 11 is driven in the arrowhead direction s. A charging charger 12, a laser exposure apparatus 13, a developing apparatus 14, a transfer charger 16, a peeling charger 17, a cleaner 18 having a cleaning blade 18*a* and a charge removing LED 19 are configured around the photoconductive drum 11.

The charging charger 12 make the photoconductive drum 11 become −750V charged equally and sequentially according to rotation of the photoconductive drum 11. The laser exposure apparatus 13 irradiates laser 13*a* corresponding to image information to an irradiated position 13*b* of the charged photoconductive drum 11.

A paper P serving as a recording medium is taken out from a paper feed cassette apparatus 20 using a paper feed roller 21. A toner image is formed on the photoconductive drum 11, and at the same time, the paper P is conveyed to the position of the transfer charger 16 of the image forming unit 10 by a register roller 22. The toner image is formed on the paper P by the image forming unit 10.

After the transfer is completed, the photoconductive drum 11 cleans the residual toner using the cleaner 18 and removes the residual charges using the charge removing LED 19, the processing is ended.

Figure 3:
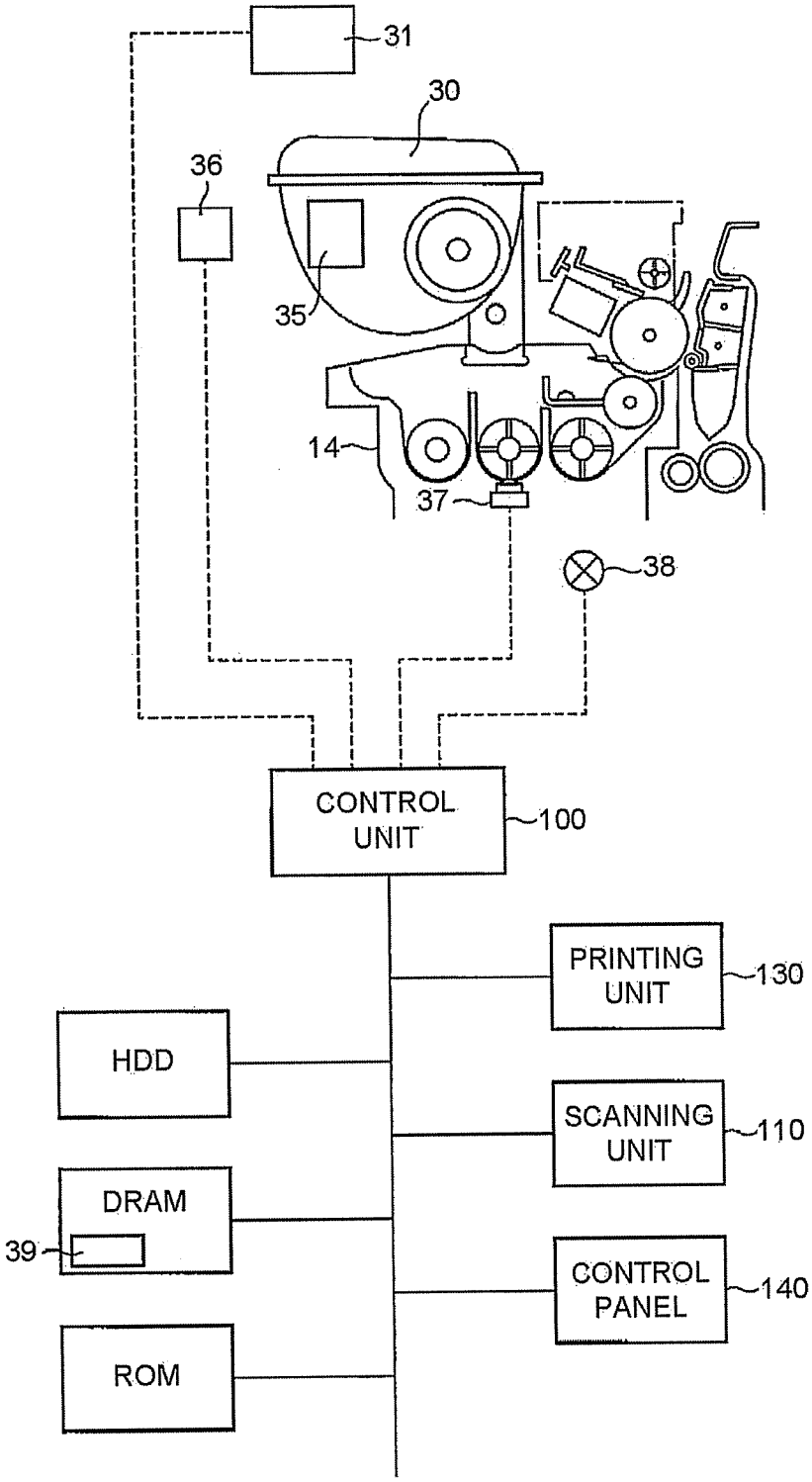
FIG. 3 is a block diagram illustrating a unit of the image forming apparatus for grasp a toner shortage state and the configuration of a control system of the image forming apparatus according to the embodiment.

FIG. 3 is a block diagram illustrating a unit of the image forming apparatus 1 for grasp a toner shortage state and the configuration of a control system of the image forming apparatus according to the embodiment.

As shown in the upper part of FIG. 3, a toner cartridge 30 is configured above the developing apparatus 14. A replenishment mechanism (feeding auger) in the toner cartridge 30 is driven through the rotation of a toner replenishment motor 31, thereby making the toner fall into the developing apparatus 14 to feed the toner.

A conveyance mechanism for conveying, while stirring, a developer containing the toner replenished and a residual toner detection sensor 37 for measuring the permeability of the developer are configured in the developing apparatus 14. As the concentration of the magnetic carrier in the developer changes when the toner concentration of the two-component system developer in the developing apparatus 14 changes, the magnetic permeability of the developer changes as well. Consequentially, the shortage of the toner can be detected using the measurement value of the residual toner detection sensor 37.

Further, a storage medium 35 is configured in the toner cartridge 30. The information relative to the toner cartridge 30 is stored in the storage medium 35 which will be described in detail later. Moreover, the reading/writing unit 36 reads information from the storage medium 35 or writes information into the storage medium 35.

Further, a temperature and humidity sensor 38 is configured in the image forming apparatus 1 to measure the environmental temperature and humidity of the image forming apparatus 1 for a change in the temperature or humidity will lead to a change in the number of the revolutions of the toner replenishment motor 31. In the image forming apparatus 1, the number of the revolutions of the toner replenishment motor 31 is corrected according to the measurement value of the temperature and humidity sensor 38 and controlled to be a given number of revolutions.

Next, the control system of the image forming apparatus 1 shown in the lower part of FIG. 3 is described.

In addition the aforementioned printing unit 130, scanning unit 110 and control panel 140, the image forming apparatus 1 further comprises a control unit 100, an ROM, a DRAM and an internal storage apparatus (HDD). The units of the image forming apparatus are connected with each other via a system bus.

The control programs necessary for the image forming apparatus 1 to act are stored in the ROM. The programs for controlling the under-mentioned image forming action and the under-mentioned toner shortage grasp action are stored in the ROM. The execution of each of the programs is controlled by the control unit 100. The DRAM is a buffer memory for temporarily storing the data generated during the execution of the programs.

Moreover, the control unit 100 is at least directly or indirectly connected with the residual toner detection sensor 37, the temperature and humidity sensor 38, the reading/writing unit 36 and the toner replenishment motor 31. The control unit 100 controls the actions of the units connected with each other via the system bus and the units relative to the grasp of the shortage of toner.

In addition, a file 39, in which the information relative to the grasp of the shortage of the toner at the side of the image forming apparatus 1 is stored, is stored in the DRAM.

FIG. 4 is a diagram illustrating the information stored in the storage medium 35 arranged at the side of the toner cartridge in the image forming apparatus according to the embodiment. The content of the information is described in detail below.

The information 'identification code' stored in Address 3001 is information for identifying the toner cartridge 30. For example, information 'toner is certified product', information on the manufacture of the toner (e.g. manufacture location, lotto number), and color information are equivalent to the information 'identification code'.

Information 'count value' stored in Address B002 is the integrated value of the operation time (counter) of the toner replenishment motor 31 that is connected with the toner cartridge 30 to drive a toner replenishment mechanism. Additionally, it should be noted that the integrated value of the operation time is hereinafter referred to as counter, however, the counter may be a value integrated by a value corresponding to the operation time, but not limited to the integrated value of the operation time.

Information 'empty information' stored in Address B003 is information indicative of whether or not the toner in the toner cartridge of the image forming apparatus 1 is empty. The initial state 'empty information' indicates that the toner cartridge is not empty (=0). When it is determined according to the determination logic which will be described later that the toner cartridge is empty, the control unit 100 records that the toner cartridge is empty (=1)

FIG. 5 is a diagram illustrating the information stored in the file 39 in the DRAM arranged at the main body side of the image forming apparatus according to the embodiment. The content of the information is described in detail below.

The information 'identification code' stored in Address A001 is information for identifying the toner cartridge 30. The information is the value of the information 'identification code' read from Address B001 of the storage medium 35.

Information 'count value' stored in address A002 is the integrated value of the operation time (counter) of the toner replenishment motor 31 connected with the toner cartridge 30. For example, an integration processing is carried out (value is integrated) during the execution process of the toner replenishment action of the image forming apparatus, and after a job is ended, the integrated value is written back to Address B002 of the storage medium 35 arranged at the side of the toner cartridge.

Information 'empty information' stored in Address A003 is flag information indicative of whether or not the toner in the toner cartridge of the image forming apparatus 1 is empty. The initial state 'empty information' indicates that the toner cartridge is not empty (=0). When it is determined according to the determination logic which will be described later that the toner cartridge is empty, the control unit 100 records that the toner cartridge is empty (=1).

A method for determining whether or not the toner is empty is described below.

Figure 6:
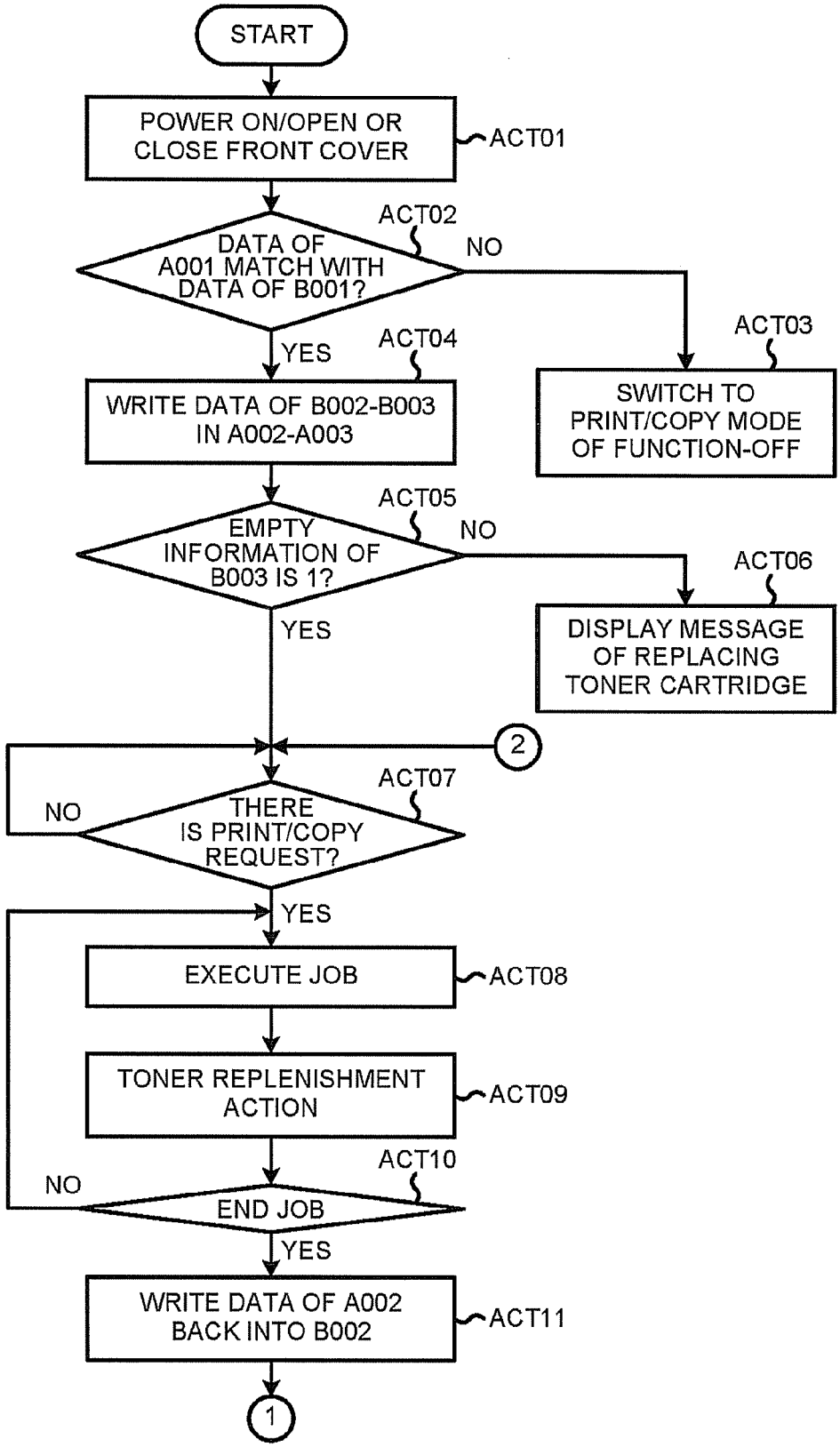
FIG. 6 is a flow chart illustrating the toner empty determination procedures executed in the image forming apparatus according to the embodiment.
Figure 7:
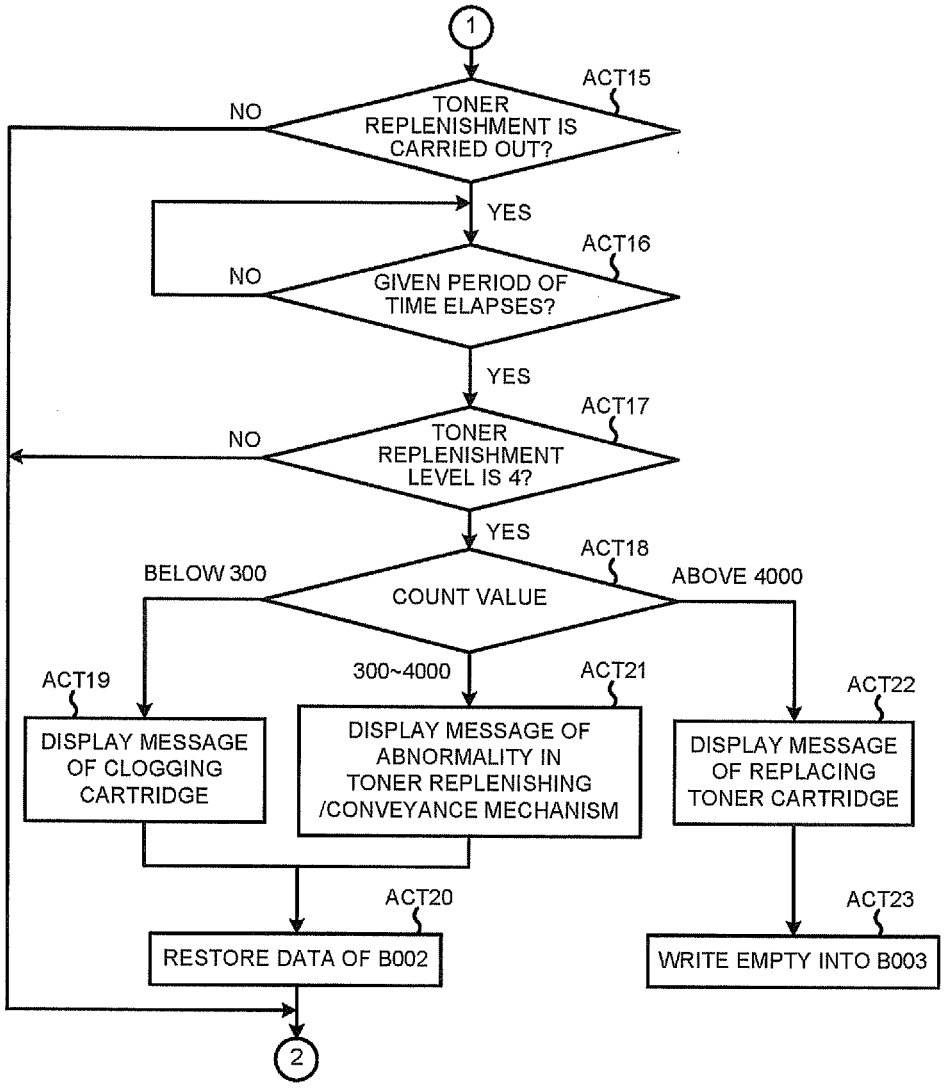
FIG. 7 is a flow chart illustrating the toner empty determination procedures executed in the image forming apparatus according to the embodiment.

FIG. 6 and FIG. 7 are flow charts illustrating the toner empty determination procedures executed in the image forming apparatus according to the embodiment.

In Act 01, the toner cartridge 30 can be replaced when the image forming apparatus 1 is powered on or the front cover of the image forming apparatus is opened or closed. Consequentially, in Act 02, a determination is made as to whether or not the 'identification code' stored in Address A001 of the file 39 in the DRAM arranged at the main body side is the same as that stored in Address B001 of the storage medium 35 arranged at the side of the toner cartridge.

If the 'identification code' stored in Address A001 of the file 39 in the DRAM arranged at the main body side is different from that stored in Address B001 of the storage medium 35 arranged at the side of the toner cartridge (ACT 02: NO), then the manufacturers of the toner cartridges 30 are different. As a result, in Act 03, switch to the print/copy mode which not carry out the toner empty determination described below. This mode is carried out according to the conventional way, so omit the details of this mode.

If the 'identification code' stored in Address A001 of the file 39 in the DRAM arranged at the main body side is the same as that stored in Address B001 of the storage medium 35 arranged at the side of the toner cartridge (ACT 02: YES), in ACT 04, the control unit 100 writes the data in Addresses B002-B003 of the storage medium 35 to Address A002-A003 of the file 39 of the DRAM. In this way, the information of the main body side is synchronized with that of the toner cartridge side 30.

In ACT 05, the control unit 100 checks whether or not the empty information of toner in Address B003 is 1, that is, whether or not the toner in the toner cartridge 30 is empty. If the toner in the toner cartridge 30 is empty (ACT 05: NO), in ACT 06, the control unit 100 displays a message 'replace toner cartridge' on the control panel 140 and then ends the processing.

If the toner in the toner cartridge 30 is not empty (ACT 05: YES), in ACT 07, the control unit 100 checks whether or not there is a print/copy request. If there is no print/copy request (ACT 07: NO), the control unit 100 waits until there is a print/copy request. If there is a print/copy request (ACT 07: YES), in ACT 08, the control unit 100 executes the requested job (print/copy)

In the execution process of the job, if the residual toner detection sensor 37 detects that the toner in the developing apparatus 14 is little, in ACT 09, the control unit 100 replenishes the developing apparatus 14 with the toner in the toner cartridge 30. At this time, the control unit 100 increment the count value gradually according to the operation time of the toner replenishment motor 31.

Figures 8, 9:
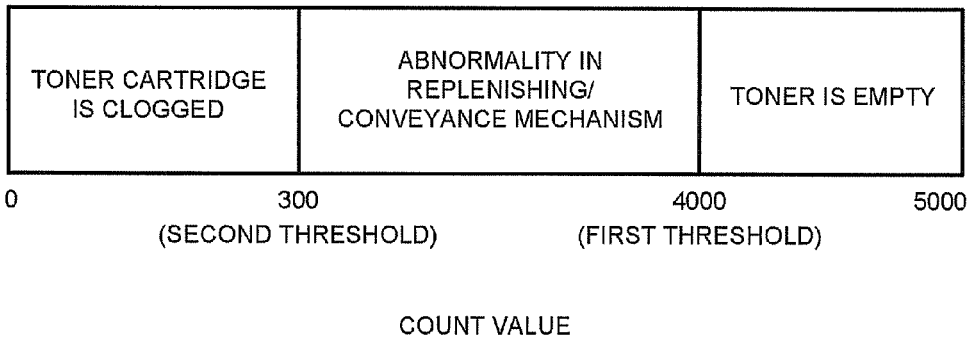
FIG. 8 is a diagram exemplarily illustrating a toner replenishment action example carried out in the image forming apparatus according to the embodiment.
FIG. 9 is a diagram illustrating the reason for the empty of the toner in the image forming apparatus according to the embodiment.

FIG. 8 is a diagram exemplarily illustrating a toner replenishment action example carried out in the image forming apparatus according to the embodiment.

When the detection level of the residual toner detection sensor 37 is level 1, for example, when the toner specific concentration in the developing apparatus 14 is reduced by 0-0.3 WT %, the control unit 100 executes an action of rotating the toner replenishment motor 31 for 2 seconds and then stopping the toner replenishment motor 31 for 5 seconds.

When the detection level of the residual toner detection sensor 37 is level 2, for example, when the toner specific concentration in the developing apparatus 14 is reduced by 0.3-0.6 WT %, the control unit 100 executes an action of rotating the toner replenishment motor 31 for 4 seconds and then stopping the toner replenishment motor 31 for 5 seconds twice.

When the detection level of the residual toner detection sensor 37 is level 3, for example, when the toner specific concentration in the developing apparatus 14 is reduced by 0.6-0.8 WT %, the control unit 100 executes an action of rotating the toner replenishment motor 31 for 8 seconds and then stopping the toner replenishment motor 31 for 5 seconds twice.

When the detection level of the residual toner detection sensor 37 is level 4, for example, when the toner specific concentration in the developing apparatus 14 is reduced by more than 0.8 WT %, the control unit 100 executes an action of rotating the toner replenishment motor 31 for 20 seconds and then stopping the toner replenishment motor 31 for 5 seconds for three times.

In ACT 10, a determination is made as to whether or not the job is ended. If the job is not ended (ACT 10: NO), the flow returns to ACT 08 to repeat the aforementioned processing. If the job is ended (ACT 10: YES), in ACT 11, the control unit 100 writes the data (count value) in Address A002 of the file 39 of the DRAM into Address B002 of the storage medium 35.

In ACT 15, the control unit 100 checks whether or not a toner replenishment is executed. If the toner replenishment is not executed (ACT 15: NO), the control unit 100 returns to ACT 07 shown in FIG. 6 to wait until there is a request for a next job (print/copy). If the toner replenishment is executed (ACT 15: YES), in ACT 16, the control unit 100 checks whether or not a given period of time elapses. The given period of time is equivalent to the time spent on waiting for a state in which a current toner specific concentration can be measured after the replenishment of the toner.

If the given period of time is not reached (ACT 16: NO), the control unit 100 waits until the given period of time elapses. If the given period of time elapses (ACT 16: YES), in ACT 17, the control unit 100 checks whether or not the detection level of the residual toner detection sensor 37 is level 4.If the toner replenishment level detected by the residual toner detection sensor 37 is not level 4 (ACT 17: NO), the control unit 100 returns to ACT 07 shown in FIG. 6 to wait until there is a request for a next job (print/copy).

If the toner replenishment level detected by the residual toner detection sensor 37 is level 4 (ACT 17: YES), in ACT 18, the control unit 100 checks the data (count value) in Address A002 of the file 39 of the DRAM and outputs a message according to the count value.

FIG. 9 is a diagram illustrating the reason for the empty of the toner in the image forming apparatus according to the embodiment. A count value and the reason for an abnormality corresponding to the count value are shown in FIG. 9.

The quantity of the toner stored in the toner cartridge 30 is converted to a count value the maximum value of which is 5000. If the toner replenishment level detected by the residual toner detection sensor 37 is level 4 and the count value integrated at this time is above a first threshold (=4000), then most of the toner in the toner cartridge 30 is consumed, therefore, it can be determined that the toner in the toner cartridge 30 is empty.

On the other hand, when in a storage state presented prior to the setting of the toner cartridge 30 on the image forming apparatus 1, toner is compactly filled nearby a toner discharge opening, leading to a possible decrease in the replenishment quantity of the toner. This phenomenon only happens when the toner cartridge is used for the first time. Therefore, if the toner replenishment level detected by the residual toner detection sensor 37 is level 4 and the count value integrated at this time is not greater than (smaller than or equal to) a second threshold (=300) smaller than the first threshold (=4000), then it can be determined that the toner cartridge 300 is clogged.

If the toner replenishment level detected by the residual toner detection sensor 37 is level 4 and the count value integrated at this time is smaller than the first threshold (=4000) but greater than a second threshold (=300), then it can be determined that toner is smoothly fed from the toner cartridge 30 and that the toner cartridge 30 is capable of storing more toner. Therefore, it can be determined in this case that there is an abnormality in the replenishment mechanism replenishing the developing apparatus 14 with the toner in the toner cartridge 30 or in the conveyance mechanism conveying toner in the developing apparatus 14.

When the count value integrated in ACT 18 shown in FIG. 17 is below the second threshold (=300), in ACT 19, the control unit 100 displays an alarm message 'toner clogged in toner cartridge' on the control panel 140.

Then, in ACT 20, the count values in Addresses A002 and B002 is restored to the value before the addition For example, the value after the addition is subtracted from the count value. Then, the flow returns to ACT 07 shown in FIG. 6 to wait until there is a request for a next print/copy job. Therefore, when there is an abnormality in the supply of the toner, an error value counted in the job will not be added, which keeps the correct count value.

When the count value integrated in ACT 18 is greater than the second threshold (=300) but smaller than the first threshold (=4000), the control unit 100 displays an alarm message 'an abnormality in supply of toner and conveyance mechanism' on the control panel 140 in ACT 21. Then, the control unit 100 executes ACT 20. In addition, as already described above, ACT 20 is not described here.

When the count value integrated in ACT 18 is above the first threshold (=4000), in ACT 22, the control unit 100 displays an alarm message 'replace toner cartridge' on the control panel 140. In ACT 23, the control unit 100 fills the data (empty information) in Address A003 of the file 39 in the DRAM with '1' and writes the data to Address B003 of the storage medium 35. In this way, the toner cartridge 30, the empty information of which is recorded as '1' is unusable later in the image forming apparatus. Then, the control unit 100 ends the processing.

Further, although a monochrome type image forming apparatus is described in the embodiments above, the present invention is not limited to this, and apparently, 4-drum tandem type image forming apparatus comprising a plurality of developing apparatuses is also applicable.

Further, the functions described in the embodiments above may be achieved by hardware, or the functions may be recorded in software programs, which are then read into a computer to achieve the functions. Moreover, the functions may be achieved by either of appropriate software or appropriate hardware.

Further, the functions may be achieved by reading a program stored in a recording medium (not shown) into a computer. Although the recording medium described in the embodiments herein can be any recording medium that is readable to a computer, the recording form of the recording medium may be any form.

In addition, the present invention is not limited to the above-described embodiments, and various other embodiments can be devised without departing from the scope of the present invention.

Furthermore, various inventions can be devised by combining a plurality of the components appropriately disclosed in the embodiments of the present invention. For example, several of the components disclosed in the embodiment may be removed, or components given in different embodiments may be combined appropriately.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a toner cartridge configured to store the toner for replenishing a developing apparatus;

a storage medium configured to be arranged in the toner cartridge;

a detection sensor configured to be arranged in the developing apparatus and detect the toner specific concentration of the developer in the developing apparatus;

a drive motor configured to replenish the developing apparatus with the toner from the toner cartridge; and a control unit configured to calculate a value corresponding to the drive time of the drive motor to calculate an integrated count value for the toner cartridge, and output a message containing the cause of an abnormity corresponding to the count value when the toner specific concentration detected by the detection sensor shows a value indicating the empty of the toner, wherein the count value and an empty information indicating whether or not the toner cartridge is empty are stored in the storage medium; and wherein the control unit outputs a message that the toner cartridge is empty when the count value is above a first threshold, outputs a message that the toner in the toner cartridge is clogged when the count value is below a second threshold which is smaller than the first threshold, and outputs a message that at least one of a toner replenishment mechanism and a toner conveyance mechanism have an abnormality when the count value is smaller than the first threshold but greater than the second threshold.

2. The image forming apparatus according to claim 1, wherein the control unit writes an information that the toner cartridge is empty in the empty information of the storage medium when the count value is above the first threshold.

3. The image forming apparatus according to claim 2, wherein the control unit subtracts the calculated value corresponding to the drive time from the count value when the count value is below the second threshold which is smaller than the first threshold.

4. The image forming apparatus according to claim 3, wherein the control unit reads the empty information from the storage medium when the image forming apparatus is powered on or the front cover of the image forming apparatus is opened and closed, and the execution of a copy and a print are prohibited when the empty information indicates that the toner cartridge is empty.

* * * * *